US009731537B2

(12) United States Patent
Mueller

(10) Patent No.: US 9,731,537 B2
(45) Date of Patent: Aug. 15, 2017

(54) METHOD FOR PROVIDING A STACK COMPOSED OF BOOK COVERS FOR BOOK PRODUCTION

(75) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 940 days.

(21) Appl. No.: 13/101,666

(22) Filed: May 5, 2011

(65) Prior Publication Data

US 2011/0280688 A1 Nov. 17, 2011

(30) Foreign Application Priority Data

May 12, 2010 (CH) ..... 0759/10

(51) Int. Cl.
*B42D 3/00* (2006.01)
*B42D 15/00* (2006.01)
(Continued)

(52) U.S. Cl.
CPC ..... *B42C 11/04* (2013.01); *B42C 19/02* (2013.01); *B65H 1/22* (2013.01); *B65H 7/02* (2013.01);
(Continued)

(58) Field of Classification Search
CPC ..... B42C 11/04; B42C 19/02; B65H 1/22; B65H 83/02; B65H 7/20; B65H 7/02;
(Continued)

(56) References Cited

U.S. PATENT DOCUMENTS 6,206,358 B1 * 3/2001 Yamaguchi et al. ..... 412/11
2004/0098665 A1 5/2004 Kasahara et al.
(Continued)

FOREIGN PATENT DOCUMENTS

EP 0 895-872 2/1999
EP 1 780-037 5/2007
(Continued)

OTHER PUBLICATIONS

International Search Report of CH 7592010 Dated Aug. 31, 2010 With an English Translation.

*Primary Examiner* — Moshe Wilensky
*Assistant Examiner* — Justin V Lewis
(74) *Attorney, Agent, or Firm* — FisherBroyles, LLP; Robert Kinberg

(57) ABSTRACT

A method for providing a stack of book covers for production of finished books includes supplying a task stack of book covers having identical cover formats and stacked one above another in an unknown or known sequence. Each book cover in the task stack includes an identifier comprising cover information. The book covers are separated out and conveyed from the task stack as separate book covers in a sequence that does not change until a completion signal is transmitted. The separated out book covers are counted, an identifier on each separated out book cover is detected, and cover information is read out of the respective identifier stored. The separated out book covers are deposited on top of one another in the sequence in which they were separated out for forming a detected stack. An identifier is stored that identifies the detected stack together with the temporarily stored cover information.

13 Claims, 3 Drawing Sheets

(51) Int. Cl.

| | |
|---|---|
| ***B42C 9/00*** | (2006.01) |
| ***B42C 7/00*** | (2006.01) |
| ***B42C 11/00*** | (2006.01) |
| ***B42C 11/04*** | (2006.01) |
| ***B42C 19/02*** | (2006.01) |
| ***B65H 1/22*** | (2006.01) |
| ***B65H 7/02*** | (2006.01) |
| ***B65H 7/20*** | (2006.01) |
| ***B65H 83/02*** | (2006.01) |

(52) U.S. Cl.
CPC ..... *B65H 7/20* (2013.01); *B65H 83/02* (2013.01); *B65H 2301/4311* (2013.01); *B65H 2301/4381* (2013.01); *B65H 2511/415* (2013.01); *B65H 2511/512* (2013.01); *B65H 2553/43* (2013.01); *B65H 2701/1244* (2013.01); *B65H 2701/12422* (2013.01); *B65H 2701/1768* (2013.01); *B65H 2801/15* (2013.01); *B65H 2801/48* (2013.01)

(58) Field of Classification Search
CPC ..... B65H 2801/15; B65H 2511/512; B65H 2701/1768; B65H 2511/415; B65H 2301/4311; B65H 2701/1244; B65H 2553/43; B65H 2801/48; B65H 2301/4381; B65H 2701/12422
USPC ..... 281/17, 19.1, 29; 283/64; 412/1, 3, 4, 5, 412/6
See application file for complete search history.

(56) References Cited

U.S. PATENT DOCUMENTS

| | | | | |
|---|---|---|---|---|
| 2008/0031706 | A1* | 2/2008 | Silberbauer | B42C 11/02 412/19 |
| 2008/0138170 | A1* | 6/2008 | Sturnick | B42C 19/02 412/4 |

FOREIGN PATENT DOCUMENTS

| | | |
|---|---|---|
| EP | 1 780-038 | 5/2007 |
| WO | WO 99/36338 | 7/1999 |

* cited by examiner

METHOD FOR PROVIDING A STACK COMPOSED OF BOOK COVERS FOR BOOK PRODUCTION

CROSS-REFERENCE TO RELATED APPLICATION

This application claims the priority of Swiss Patent Application with No. 00759/10, filed on May 12, 2010, the subject matter of which is incorporated herein by reference.

BACKGROUND OF THE INVENTION

The invention relates to a method for providing a stack composed of book covers for the production of finished books and an apparatus as for providing a stack composed of book covers for the book production, as well as a book production line provided with an apparatus of this type.

Known book production lines respectively combine one book block and one book cover to form a book during successive cycles.

The book blocks and the book covers are normally produced in separate machines. In known book production lines, the book block initially moves separately from the associated book cover through the processing stations, for example the stations for rounding, pressing, applying adhesive to the back, attaching headbands and the like. The so-called marriage or joining of the book block and the book cover subsequently takes place in the casing-in machine, wherein the casing-in machine is understood to be one production unit in the book production line.

Once it arrives at the casing-in machine, the book block which rests straddling on a saddle plate is guided vertically past an applicator for applying adhesive to the sides of the book block, for example an applicator as disclosed in European patent document EP 1 780 037. In the process, adhesive is applied to two fly leaves of the book block. Via feeding rails and with the aid of a pusher, the book cover is supplied horizontally above the side adhesive applicator and is positioned above the arriving book block. Following this, a pressing on device such as disclosed in European patent document EP 1 780 038 takes over the book cover and joins it precisely fitting with the book block.

Known book production lines process medium to large book editions. An equivalent number of book covers are therefore made available for a series consisting of several book blocks. The sequence is not important since the cover and book block of each book is joined in the same way for the same edition.

However, when producing personalized books such as photo albums, the book block and the cover represent unique items. An unambiguous identification of the book cover and the book block is thus generally a decisive criterion for producing personalized books or small and micro-editions. To ensure a non-problematic processing in the machine, either the book cover or the book block must take on a control function. As a result, one component of the later book is used to predetermine for the book production line which part must be joined to what other part.

SUMMARY OF THE INVENTION

An object therefore is to make possible a targeted and flexible integration of one of the book components for a book produced in a small or micro-edition into a book production line, to achieve the most economical and secure allocation of the components to be joined.

The above and other objects are achieved according to one aspect of the invention, wherein there is provided a method for providing a stack composed of book covers for production of finished books, which in one embodiment comprises: compiling of book covers, stacked one above another in an unknown or known sequence and provided with unknown cover information to form a task stack, wherein the book covers of the task stack have identical cover formats; separating out and conveying of the book covers from the task stack as separate book covers in a sequence that does not change for the following method steps, until completion signal is transmitted; counting the separated out book covers, detecting of an identifier on each separated out book cover, reading cover information out of the respective identifier, and temporarily storing the cover information; depositing the separated out book covers one on top of the other in the sequence in which they were separated out for forming a detected stack; and storing an identifier that identifies the detected stack together with the temporarily stored cover information.

According to a further aspect of the invention there is provided and an apparatus for providing a stack composed of book covers for the book production, which in one embodiment comprises: a cover magazine to separate out book covers with identical format from a task stack in a known or unknown sequence and to convey the separated out book covers in longitudinal direction through the apparatus, wherein each of the separated out book covers is provided with an identifier comprising cover information; at least one detection device arranged to at least one of count the separated out book covers, detect the respective identifier, and read the cover information out of the identifier; and a processing unit to process the cover information, wherein the cover information is at least one of stored with the aid of the processing unit and communicated to an external cover-matching system by the processing unit.

According to yet another aspect of the invention there is provided a book production line as disclosed which is provided with such an apparatus as described above.

With the described method for providing a stack composed of book covers for the book production, book covers are compiled in an unknown or known sequence, stacked one above the other and provided with unknown cover information, so as to form a task stack. The book covers in the task stack have a cover format that is the same for all book covers in the task stack. Subsequently, or also during the stack formation, the book covers from the task stack are separated out as individual book covers that are conveyed in an unchanged sequence which does not change even during the following methods steps, until a completion signal is sounded.

The separated out book covers are counted, an identifier is detected on each book cover and cover information is read out of the respective identifier, wherein this cover information is also stored temporarily. The separated out book covers are deposited in the sequence in which they are separated out to form a detected stack and an identifier for identifying the detected stack may be stored together with the temporarily stored cover information.

Book covers which are produced externally before the start of the operation are normally delivered in stacks, for example packages such that the outside of the book covers that is imprinted with the title is pointing either toward the top or toward the bottom. Depending on the delivery condition, the sequence of the book covers is ascending or descending. The imprinted outside should later on also form the imprinted outside of the book. The imprinted outside is provided with an identifier containing bits of information, such as data relating to the book cover format.

The identifier, for example a barcode, as a rule is configured such that it displays information on the cover which relates to the format, the material, and the client. The configuration of such a code depends on the barcode standard used and client-specific requirements, wherein the code is configured with multiple sections. For example, the first section can represent a coding of the task with format data and material data, followed by client data which in turn contains an individual design type. By presorting the products to be produced according to format and material, the information can be utilized to realize a more economic production of the books by gathering task stacks of the same format, to be understood as sequences. Following the separating out, the client information can advantageously be used to control an individual cover design which need not be completed until just before the cover is joined to the book block. In addition to the barcode, other types of identifiers or identification marks can conceivably be used, which are known to one skilled in the art and can be read with the aid of devices for image recognition or optical character recognition. Identifiers using RFID (radio frequency identification) or magnetic information carriers can also be used.

The task stack can be deposited directly in front of the separating device, for example in a manual operational step. Following the separating out of the last book cover from the task stack, the completion signal can be triggered, for example through manual release by a machine operator. However, if the task stack is not yet finished, even though the separating device at times does not contain a stored book cover, then covers are supplied manually and released later on. More involved methods provide for an extended storage in several task stacks. For example, a first task stack is deposited with the side edges of the book covers resting on a conveying belt and is then tilted in a longitudinal direction toward the separating device. A following stack, which should also belong to the first task stack, can be deposited right behind it and can then be tilted onto the incomplete, first task stack resting in a scaled formation on the conveying belt, if possible so that no gap develops between the book covers in the scaled arrangement. A gap should not develop until after the last book cover from the first task stack is positioned on the conveying belt.

Following this, a second and a third, if applicable also additional task stacks, are preferably positioned in the same way on the conveying belt.

Gaps of the above-described type are placed strategically to respectively mark the end of one of the task stacks. The gap is easily recognized by the machine operator, wherein a light curtain can also be used detect the gap. In reaction to the gap, for example, the conveying belt is stopped.

Alternatively, the number of book covers in a detected stack can also be specified. In that case and based on a method of this type, the separating out operation is stopped following the respective number of operating cycles.

The method provides that the separated out book covers move through one or several devices, intended for counting the book covers, for detecting the respective identifier, for reading at least one of the cover information bits of the identifier, and for temporarily storing the cover information. The detected, separated out book covers are subsequently deposited one on top of the other in the sequence in which they were separated out in order to form a complete, detected stack. Following this, an identifier that identifies the detected stack is stored together with the temporarily stored cover information.

The previously described method is also suitable for checking whether stacks with a known sequence are complete. In that case, the stack composition is known but can still be detected and/or controlled with the aid of this method, wherein this comparison is realized digitally and, if applicable, also involves a comparison of the book cover information.

Book cover stacks arriving from external book cover machines at the book production lines are normally supplied with the title pointing downward. This delivery state precisely coincides with the position as needed for the further processing in the book production line. Following the turning of the book cover stack delivered in this way, the book cover originally positioned on the top of the stack corresponds to the first cover to be processed in the magazine shaft for the separating device and is the lowest cover in the task stack. If the book covers were produced in the correct processing sequence, the identification data can be transmitted directly from the book cover machine to the book production line.

In case there is a spatial separation and/or a long distance between the book cover production and the book production line, it may be preferable to input the book cover information according to the method in an external, so-called cover matching system instead of taking over the identification data from the book production machine. In this system, the book cover sequence is detected, is checked to determine whether it meets the specifications and is transmitted as a new information packet to the book production line.

For the further processing in the book production line, the detected stack can be integrated as a sequence of book covers with the same format into the flow of book blocks and/or it can control the flow and the sequence of the book blocks. The control unit for the book production line can thus take over a comparison and control of the book covers provided with a barcode and/or book blocks at the feeding device for the book covers and/or the book blocks, wherein this device that can be equipped with a barcode reader. In case of a so-called mismatch of book block and book cover, the respective book block is conveyed out before entering the machine. The machine therefore only accommodates book blocks that meet the specification and the required sequence, as predetermined by the detected stack and/or the associated book covers located in the cover feeder.

A mismatch should in principle not be possible as a result of the above-described method. However, if a mismatch occurs nevertheless, the book production is interrupted.

One example for integrating the detected stack into the book production line is realized as follows. Two cycles prior to the joining of the book block and the book cover, a barcode reader compares the information provided on the cover to the data for the available book block. In case of a mismatch, the book production line is stopped in a controlled operation. Previously requested processing steps are still completed and the cover transport is stopped to remove the incorrect cover. Of the four books located in the casing-in machine, three are completed and moved out of the machine. The fourth book block without cover is not provided with adhesive on the side and is removed at the book delivery.

Since the removed book block is not defective and only lacks a cover, it can be supplied once more during a later processing step together with the corresponding cover.

For advantageous embodiments of the method, several or all of the aforementioned processing steps will overlap with respect to time.

According to a different advantageous embodiment, one or several bits of information from one of the book covers is/are used as identifier for the detected stack. In particular, one or several bits of information found on the last book cover deposited on the stack is/are used for this.

According to a different advantageous embodiment of the method, the completion signal is triggered by a light barrier which, following the deposited book covers, detects a gap signaling the end of the task stack.

The apparatus which makes available a stack composed of book covers for the book production is provided with a magazine for separating out book covers with identical formats from a task stack of unknown or known composition and for conveying the separated out book covers in longitudinal direction through the apparatus. Each of the separated out book covers is provided with cover information in the form of an identifier. The apparatus furthermore comprises a detection unit, or several such units, for counting the separated out book covers, for detecting the respective identifier and/or for reading the cover information out of the identifier.

The apparatus is provided with a processing unit for processing the cover information which can be stored with the aid of the processing unit and/or can be transmitted by the processing unit to an external cover-matching system. In the latter case, the cover information is stored continuously in the external system during the stack formation, until a completion signal is transmitted. The completion signal is triggered as soon as the detected stack is completely formed, which may be the case if a manual release is triggered following the complete separating out of book covers from a task stack.

The apparatus can be integrated into a book production line in such a way that no actual stack forming takes place downstream of the separating out device. The stack provided with the identifier in that case rests on a transfer belt, for example with the book covers separated out or in a scaled arrangement.

According to one advantageous embodiment of the apparatus, a stacking shaft is arranged in longitudinal direction downstream of the cover magazine for stacking the separated out book covers so as to form a detected stack. For this embodiment, it is initially operated separately from the book production line, for example as an independent unit. The transfer of the detected stack provided with respectively one identifier to the book production line can be realized manually. The identifier can be read out in the book production line. The sequence of the book blocks can be integrated into the book production line, corresponding to a data packet which is input based on the identifier for the sequence of the book covers in the transferred, detected stack.

This functions to isolate a detection device if the longitudinal conveyor is arranged in front of, respectively below the detection device.

A different advantageous embodiment of the apparatus is provided with a longitudinal conveyor that is arranged downstream of the cover magazine, as seen in longitudinal direction. Finally, the longitudinal conveyor can also be arranged downstream of the detection device and can accommodate stacks which have already been detected.

The longitudinal conveyor arranged downstream of the detection device creates a clearance space for the buffer storage of a book cover product flow, in particular approximately 100 to 200 book covers, before these are transferred to the book production line. This can be an advantage for the continuity and/or the processing safety of the manufacturing process.

The at least one detection device for a different advantageous embodiment of the apparatus is arranged in or on the cover magazine, in particular above a conveying path for the book covers, wherein this arrangement favors a compact structural design.

The at least one detection device for different, advantageous embodiments is arranged so as to be displaceable transverse to the longitudinal direction.

Yet another advantageous embodiment is provided with an identification device. With the aid of the identification device, a second identifier for identifying the stack can be affixed in or on the detected stack.

A book production line advantageously comprises one of the above-described apparatuses.

BRIEF DESCRIPTION OF THE DRAWINGS

These and other features and advantages of the invention will be further understood from the following detailed description of the preferred embodiments with reference to the accompanying drawings, which show in.

DETAILED DESCRIPTION

Figure 1:
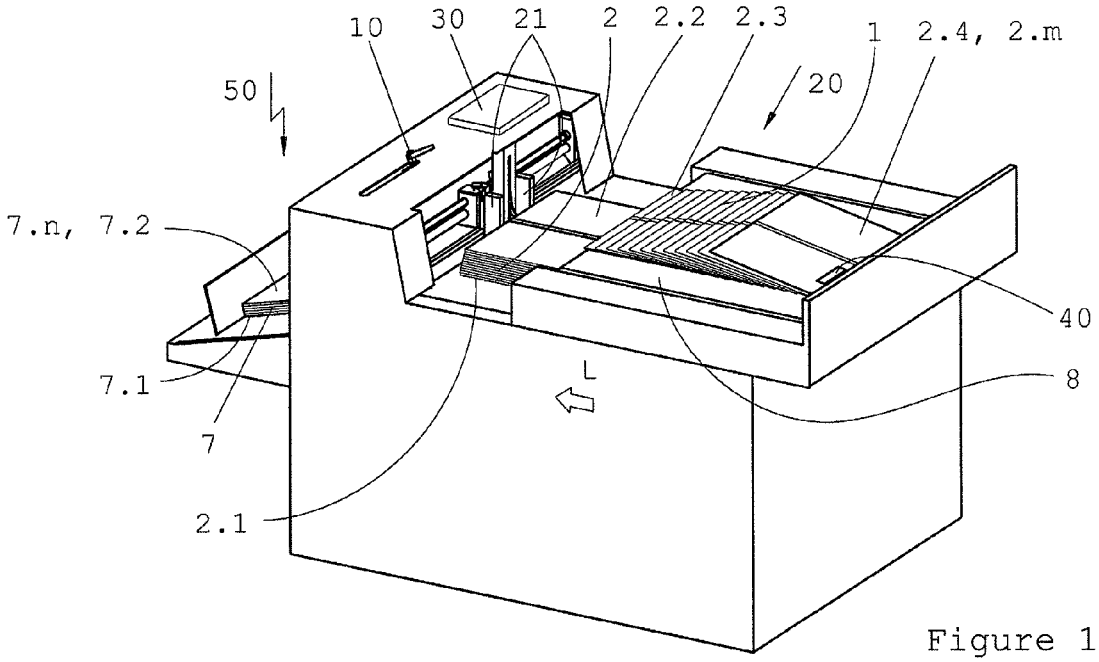
FIG. 1—A perspective representation of the apparatus according to a first exemplary embodiment.

FIG. 1 shows a first embodiment of an apparatus for providing a detected stack 7 composed of separated out book covers (7.1-7.*n*), stacked one above the other, for producing finished books. Detected in this case is the information on the respective deposited book covers 2.1-2.*m*, which are stacked in a task stack 1 that is supplied to the apparatus.

The book covers 2.1-2.*m* to be detected by the device are in most cases provided with a visible identifier 40 which can be detected and read out with the aid of a detection device 10 for reading the cover information. FIG. 1 shows an example representing a snapshot of a book cover flow moving through the apparatus. In this case, a number of book covers 7.1 to 7.2 have already been separated out of the task stack 1, shown in the form a scaled flow, and have been deposited on the growing detected stack 7. The task stack 1 is still for the most part positioned in a scaled arrangement on the conveying belt 8. The following book cover 2.1, to be separated out by the apparatus, is positioned on the underside of a partial stack 2 of the task stack 1, which is formed downstream of the conveying belt 8, wherein this partial stack 2 is gathered in front of at least one retaining bar 21, with two retaining bars 21 shown herein. Alternatively, it may be useful to provide only one retaining bar or several retaining bars that are distributed across the book cover width. While the separating device removes the book cover 2.1 from the bottom of the partial stack 2, the next book cover 2.3 from the task stack 1 in a scaled arrangement on the conveying belt 8 simultaneously drops onto the top book cover 2.2 of this partial stack 2. The forming of the partial stack 2 will be completed once the last book cover 2.4 of the task stack 1 which is positioned in front of the retaining bar 21 has been conveyed. The numbering of the book covers 2.1-2.*m* is randomly specified in this case. The book cover 2.4 may not be the fourth book cover and, as the last and final book cover of the m number of book covers 2.1 to **2.*m*, corresponds to the book cover 2.*m***.

The book covers **2.*m* are deposited one above the other on the conveying belt 8 in the form of a task stack 1, or several stacks, with unknown composition and resting on their side edges, wherein this can be a manual or an automatic operation. The task stack 1 on the conveying belt 8 is tilted forward in conveying direction to form the scaled flow. A further stack of book covers that belongs to the same production task can in the same way be placed onto the conveying belt 8, behind the tilted task stack 1 as seen in conveying direction. Finally, the book covers 2.*m* for a production task, which are to be detected, must be positioned completely and without gaps, one behind the other in a scaled arrangement, on the conveying belt 8**.

At a downstream end of the conveying belt 8, the book covers **2.*m* drop onto the partial stack 2 to be detected. The apparatus is provided with a cover magazine 20, having a separating device that is known per se, wherein the previously described conveying belt 8 can indeed be considered a component of the cover magazine 20. The partial stack 2 is held in place with the aid of two retaining bars 21 over nearly its complete height while the lowest book cover is pulled from the bottom of the partial stack 2. The lowest book cover is separated out while the cover magazine 20 ensures that only a single book cover 2.1 is removed from the bottom of the partial stack 2 in longitudinal direction L, among other things through the alignment of the retaining bar 21**.

The separating out and therewith connected conveying of the book covers 2.1-**2.*m* of the task stack 1 as separated out book covers 7.1-7.*n*** continues until a completion signal is triggered and in a sequence which does not change even during the method steps mentioned in the following.

Figure 2:
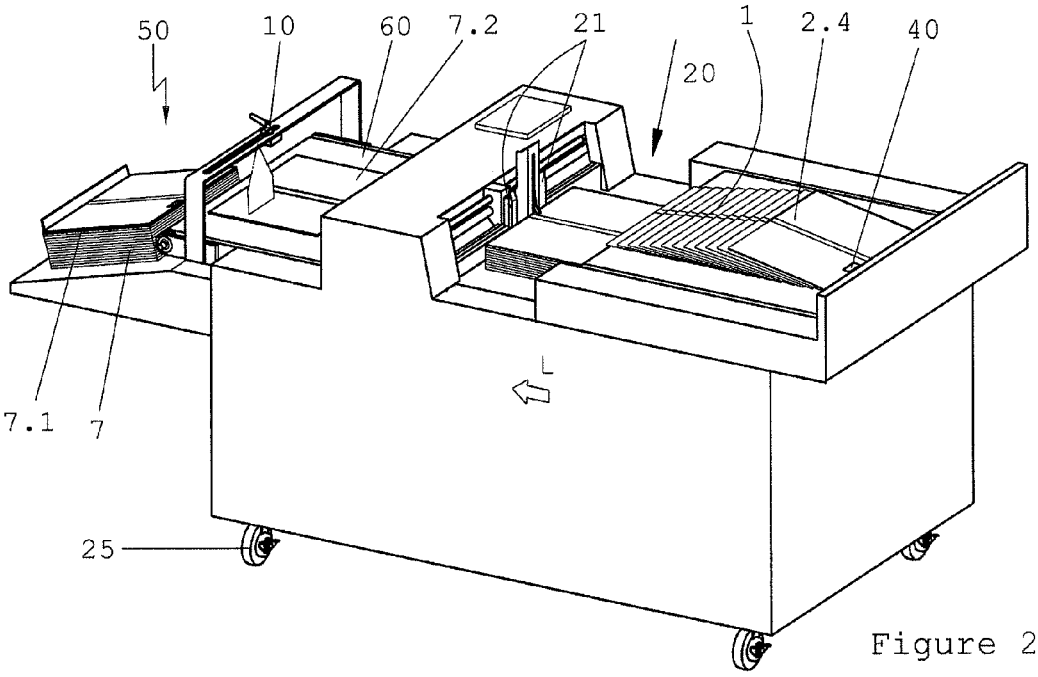
FIG. 2—A perspective representation of the apparatus according to a second exemplary embodiment, wherein the apparatus according to the second embodiment comprises a longitudinal conveyor and rollers.

Once the separated out book cover leaves the partial stack 2, it consequently also leaves the cover magazine 20 in longitudinal direction L. The separated out book cover is detected downstream of the retaining bar 21 in longitudinal direction L with the aid of a detection device 10, which is either integrated in the cover magazine 20—as shown in FIG. 1, or arranged for example—as illustrated in FIG. 2 in or on the apparatus subsequently in the longitudinal direction L. The detection device 10 sketched in FIGS. 1 and 2 is suitable for counting the book covers 7.1-**7.*n*, for detecting the identifier 40 on the separated out book covers 7.1-7.*n*, and for reading the cover information out of the identifier 40**.

The retaining bar 21 ensures that in all cases only one book cover 7.1-**7.*n* leaves the partial stack, so that the number m of deposited book covers 2.1-2.*m* corresponds to the number n of separated out book covers 7.1-7.*n*. In addition, the guaranteed removal from the bottom ensures that a separating sequence can be detected and/or monitored later on by the cover magazine 20**.

In a processing unit 30, the cover information from the book covers 2.1-**2.*m* of the task stack 1 are collected from the detection device 10 and the sequence of the separated out book covers 7.1-7.*n* of the growing, detected stack 7 are stored temporarily. Once the last book cover 7.*n* of the detected stack 7 has passed the detection device 10 and the cover information has been processed in the processing unit 30, at least one cover information bit from the last book cover 7.*n* is used for identifying the stack 7, which is completely detected once the last book cover 7.*n* is accommodated. The last book cover 7.*n* can thus be called the identifying book cover 7.*n***.

FIG. 2 shows the second exemplary embodiment of the apparatus. The apparatus is designed to be moved on rollers 25. As compared to the apparatus shown in the first exemplary embodiment, this apparatus is extended behind the retaining bar 21 of the cover magazine 20 by a longitudinal conveyor 60. The detection device 10 in this case is not integrated into the cover magazine 20. The detection device 10 is located above the flow of covers (illustrated in the snapshot by the book cover 7.2 which passes the detection device 10) at the end of the longitudinal conveyor 60 which is facing away from the retaining bar 21. Downstream of the detection device 10, the book covers 7.1-**7.*n* drop onto the detected stack 7 inside a stacking shaft 50**.

Figure 3:
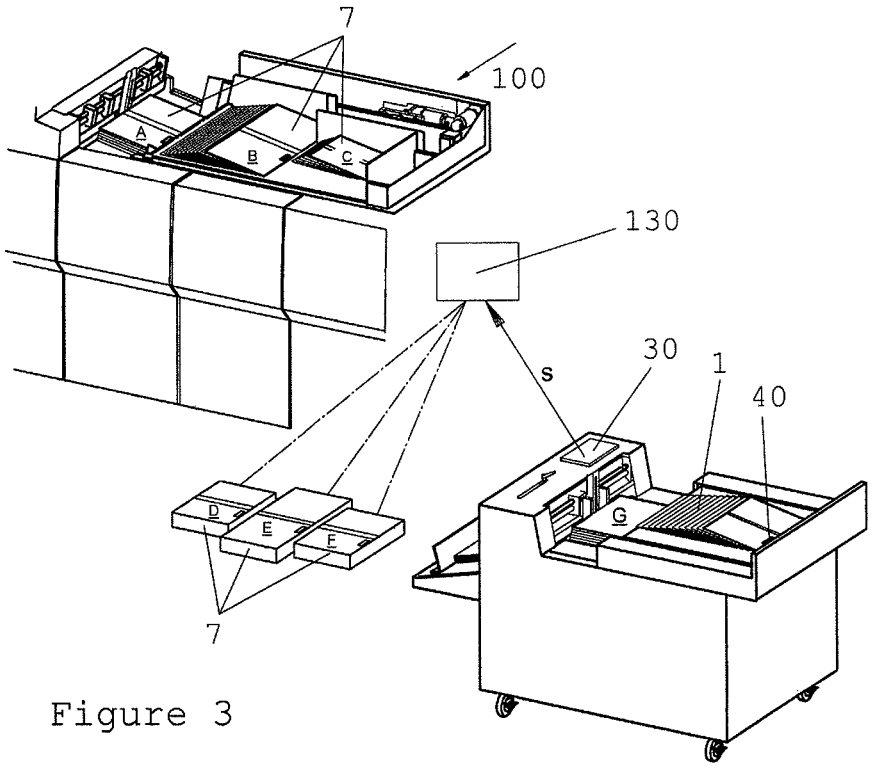
FIG. 3—A schematic diagram which illustrates the transfer of an available stack from the apparatus to a book production line.

The diagram in FIG. 3 shows a connection of the mobile apparatus to a book production line 100 in the form of a snapshot. At the instant shown herein, a task G in the form of a corresponding partial stack of book covers is located on the apparatus. The tasks D, E and F in the form of detected stacks 7 are ready for the book production line 100. Already positioned on the book production line are the tasks A, B and C, which are stacks 7 that were previously detected by the apparatus.

The apparatus generates and/or determines an identifier for each stack 7 with the aid of the processing unit 30 for processing the cover information. The cover information can be stored by the processing unit 30 and/or the processing unit 30 can communicate this information to an external cover-matching system 130, for example embodied as memory programmable control (SPS), via data transmission S. In the latter case, the cover information is stored continuously during the stack forming in the external system 130 until a completion signal is transmitted. The completion signal is transmitted as soon as the detected stack 7 is completed. For example, this may be the case when a manual release is issued following the complete separating out of the book covers from a task stack 1.

The identifier as well as all book cover information for the respective stack 7 is transmitted to the external system 130. The book production line 100 can access this stack information for each stack A to G once the following stack 7 is deposited in the form of the task D. Based on this information, a cover feeder belonging to the book production line can be controlled, for example with respect to the format. In addition, the book blocks associated with the book covers 7.1 to **7.*n*** of the task D are requested.

Owing to the store of book covers resulting from the tasks A-G, it is possible to call up the book blocks "inline" from a digital printer and/or from a following machine, in the sequence of the book covers. A known inline system is the product line "Sigma Line" by the company Müller Martini.

For example, a barcode for the respective stack 7 is input to securely integrate the detected stack 7 of the task D into the book production line 100 even during the processing of the stack 7 in the book production line 100. Two cycles before joining the book block and the book cover, the cover-matching systems 130, for example, compares the cover information for the respective book cover from the task D to the available book block data. If these do not match, the book production line is stopped in a controlled operation. Previously requested operating steps are completed. The cover transport is stopped to remove the incorrect cover. Of the four books already located in the casing-in machine of the book production line, three are completed and conveyed out of the book production line. The fourth book block without cover is not provided with adhesive on the side and is removed from a book delivery.

In place of the covers for hardcover books, covers for the soft cover production could also be used for producing finished books in a book production line. The covers, which are input with the above-described method, are supplied in so-called cover feeders to an adhesive applicator where they are combined with the book blocks.

It will be understood that the above description of the present invention is susceptible to various modifications, changes and adaptations, and the same are intended to be comprehended within the meaning and range of equivalents of the appended claims.

What is claimed is:

1. A method for providing a stack composed of book covers for production of finished books, comprising:

supplying a task stack of book covers having identical cover formats and stacked one above another in an unknown or known sequence, wherein each book cover in the task stack includes an identifier comprising cover information;

separating out and conveying the book covers from the task stack as separate book covers in a sequence that does not change for the following method steps, until a completion signal is transmitted:

counting the separated out book covers, detecting of the identifier on each separated out book cover, reading cover information out of the respective identifier, and temporarily storing the cover information;

depositing the separated out book covers directly one on top of the other in the sequence in which they were separated out for forming a detected stack; and storing an identifier that identifies the detected stack together with the temporarily stored cover information, wherein the identifiers of the respective book covers are used to request book blocks in the sequence of the book covers in the detected stack in the production of the finished books.

2. The method according to claim 1, wherein at least two of the method steps overlap with respect to time.

3. The method according to claim 1, including using at least one cover information bit from one of the book covers as the identifier for the detected stack.

4. The method according to claim 1, including using at least one cover information bit from the book cover last deposited on the detected stack as the identifier for the detected stack.

5. A method for providing a stack composed of book covers for production of finished books, comprising:

supplying a task stack of book covers having identical cover formats and stacked one above another in an unknown or known sequence, wherein each book cover in the task stack includes an identifier comprising cover information;

separating out and conveying of the book covers from the task stack as separate book covers in a sequence that does not change for the following method steps, until a completion signal is transmitted:

counting the separated out book covers, detecting of the identifier on each separated out book cover, reading cover information out of the respective identifier, and temporarily storing the cover information;

depositing the separated out book covers one on top of the other in the sequence in which they were separated out for forming a detected stack;

storing an identifier that identifies the detected stack together with the temporarily stored cover information; and triggering the completion signal by a light barrier that registers a gap following the deposited book covers at an end of the task stack to be detected.

6. An apparatus for providing a stack composed of book covers used to produce finished books, comprising:

a cover magazine to separate out book covers with identical format from a task stack in a known or unknown sequence and to convey the separated out book covers in longitudinal direction through the apparatus, wherein each of the separated out book covers is provided with an identifier comprising cover information;

at least one detection device arranged to at least one of count the separated out book covers, detect the respective identifier, and read the cover information out of the identifier; and a processing unit to process the cover information, wherein the cover information is at least one of stored with the aid of the processing unit and communicated to an external cover-matching system by the processing unit.

7. The apparatus according to claim 6, further including a stacking shaft, arranged downstream of the cover magazine as seen in a longitudinal direction, to stack the separated out book covers to form a detected stack.

8. The apparatus according to claim 6, further including a longitudinal conveyor arranged downstream of the cover magazine, as seen in longitudinal direction.

9. The apparatus according to claim 6, wherein the at least one detection device is arranged in or on the cover magazine.

10. The apparatus according to claim 9, wherein the at least one detection device is arranged above a conveying path for the book covers.

11. The apparatus according to claim 6, wherein the at least one detection device is arranged to be displaceable transverse to the longitudinal direction.

12. The apparatus according to claim 6, further including an identification device useable to affixed in or on the detected stack a second identifier as identification for the detected stack.

13. A book production line, comprising an apparatus as disclosed in claim 6.

* * * * *